US005412971A

United States Patent [19]

Axelsson

[11] Patent Number: 5,412,971

[45] Date of Patent: May 9, 1995

[54] TOOL

[75] Inventor: Stig Axelsson, Tranås, Sweden

[73] Assignee: AB Hammarprodukter, Bjursas, Sweden

[21] Appl. No.: 146,021

[22] PCT Filed: Apr. 28, 1992

[86] PCT No.: PCT/SE92/00276

§ 371 Date: Oct. 28, 1993

§ 102(e) Date: Oct. 28, 1993

[87] PCT Pub. No.: WO92/20493

PCT Pub. Date: Nov. 26, 1992

[30] Foreign Application Priority Data

May 13, 1991 [SE] Sweden ..... 9101421

[51] Int. Cl.[6] ..... B21D 39/00

[52] U.S. Cl. ..... 72/326; 72/410; 29/243.58; 7/131

[58] Field of Search ..... 72/326, 325, 410, 409, 72/464; 29/243.58, 243.57, 243.5; 7/131, 134, 129, 132

[56] References Cited

U.S. PATENT DOCUMENTS 3,774,425 11/1973 Veneziano ..... 72/326

FOREIGN PATENT DOCUMENTS 273530 5/1914 Germany ..... 72/409

62549 2/1949 Netherlands ..... 72/410

*Primary Examiner*—Daniel C. Crane

*Attorney, Agent, or Firm*—Natter & Natter

[57] ABSTRACT

A tool for use in preparation of signs of the type having a base section and sign elements engaging therewith comprises two members (7, 8) movable with respect to each other. These members comprise on one hand edge components (9, 10) for cutting the base section off, and on the other components (11) for deforming the base section so as to create obstacles for the sign elements to leave the engagement with the base section.

13 Claims, 4 Drawing Sheets

TOOL

This application is a 371 of PCT/SE92/00276, filed Apr. 28, 1992.

FIELD OF THE INVENTION AND PRIOR ART

This invention relates to a tool for use in preparation of signs of the type having a base section and sign elements engaging therewith, said tool comprising two members movable with respect to each other.

The base section of signs of the type mentioned here has longitudinal rim or edge portions folded over, so that the cross section of the base section gets a C-like shape. The sign elements have the character of usually rectangular discs, which are displaceably received in the base sections by the fact that the edge portions of the base section folded over overlap the edge portions of the sign elements. Fastening of the sign elements in the base sections is accomplished by deforming the latter at the ends thereof, more exactly by pressing the edge portions folded over inwardly towards the bottom portion of the base sections. Thus, the base sections will in other words at the ends thereof project a distance past the sign elements arranged at the ends. Holes are arranged in the end portions of the base sections projecting past the sign elements, so that the signs may by for example screws, nails or rivets be fixed to an arbitrary frame.

In accordance with the prior art several tools have been used for the preparation of the signs. Among other things, an ordinary plate shears has been used for cutting the base sections, whereas a pair of tongs have been used for pressing the edge portions of the base sections folded over. The work for preparating the signs while using different tools is time consuming and hard, on one hand as a consequence of the need to use a plurality of tools, and on the other because the tools known have not been particularly well suited for the task. A none too negligible skill of the operator is required for obtaining an acceptable final result.

SUMMARY OF THE INVENTION

The object of the present invention is to develop a tool of the kind mentioned in the introduction, which should be adapted to permit preparation of signs of the type discussed in a rational way.

This object is obtained according to the invention by giving the tool the characteristics closer defined in the appended claims.

Thanks to the fact that according to claim 1 the tool members comprise on one hand edge means for cutting the base section off, and on the other means for deforming the base section so as to create obstacles for the sign elements to leave the engagement with the base section, prerequisites for achieving the cutting off as well as the deformation in one and the same sequence of movements of the tool members are created, thereby giving the operator the possibility to carry out the work substantially more rapidly than before and an improved control of the working result is obtained in the sense that the cutting off of the base section and the deformation thereof will take place in such a way that the cutting off and the deformation get completely appropriately mutually located as a consequence of that these work operations are carried out during one and the same working stroke of the tool members with respect to each other.

The tool members also comprise means for cutting out holes in the base section in accordance with claim 2. Accordingly, an accurate location of the hole cut out, the cutting out of the base section and the deforming thereof with respect to each other is obtained, since all these work operations are carried out during one single relative movement of the tool members.

Further significant characteristics and advantages of the invention resulting thereof appear from the other claims and the following detailed description.

BRIEF DESCRIPTION OF THE DRAWINGS

With reference to the appended drawings, below follows a specific description of an embodiment of the invention cited as an example.

In the drawings.

DETAILED DESCRIPTION OF A PREFERRED EMBODIMENT

Figure 4:
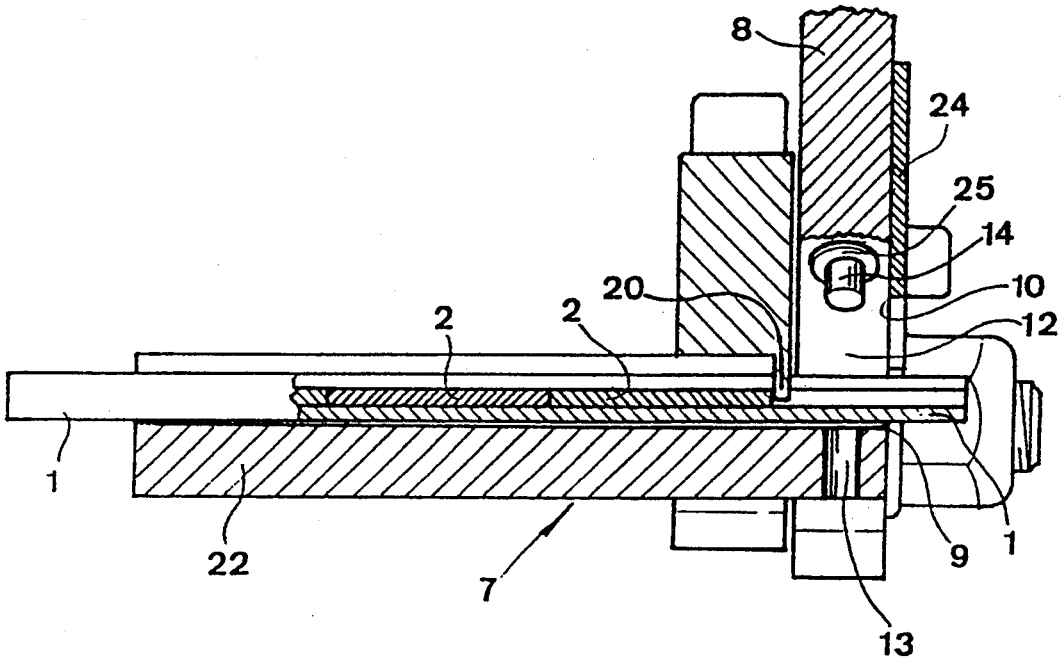
FIG. 4 is a section along the line IV—IV in FIG. 3.
Figure 5:
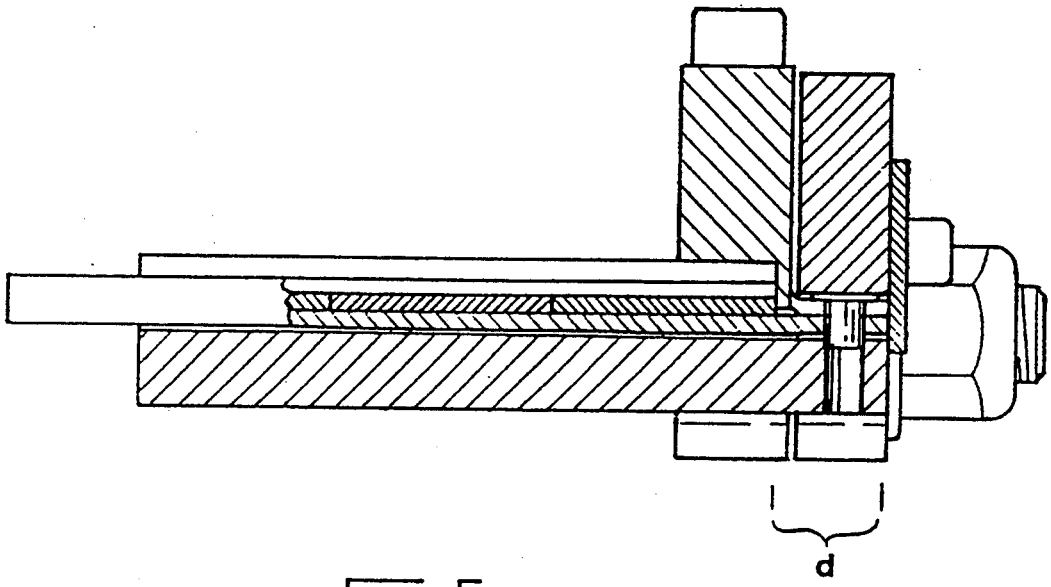
FIG. 5 is a section similar to FIG. 4 but illustrating the tool members in another relative position.
Figure 6:
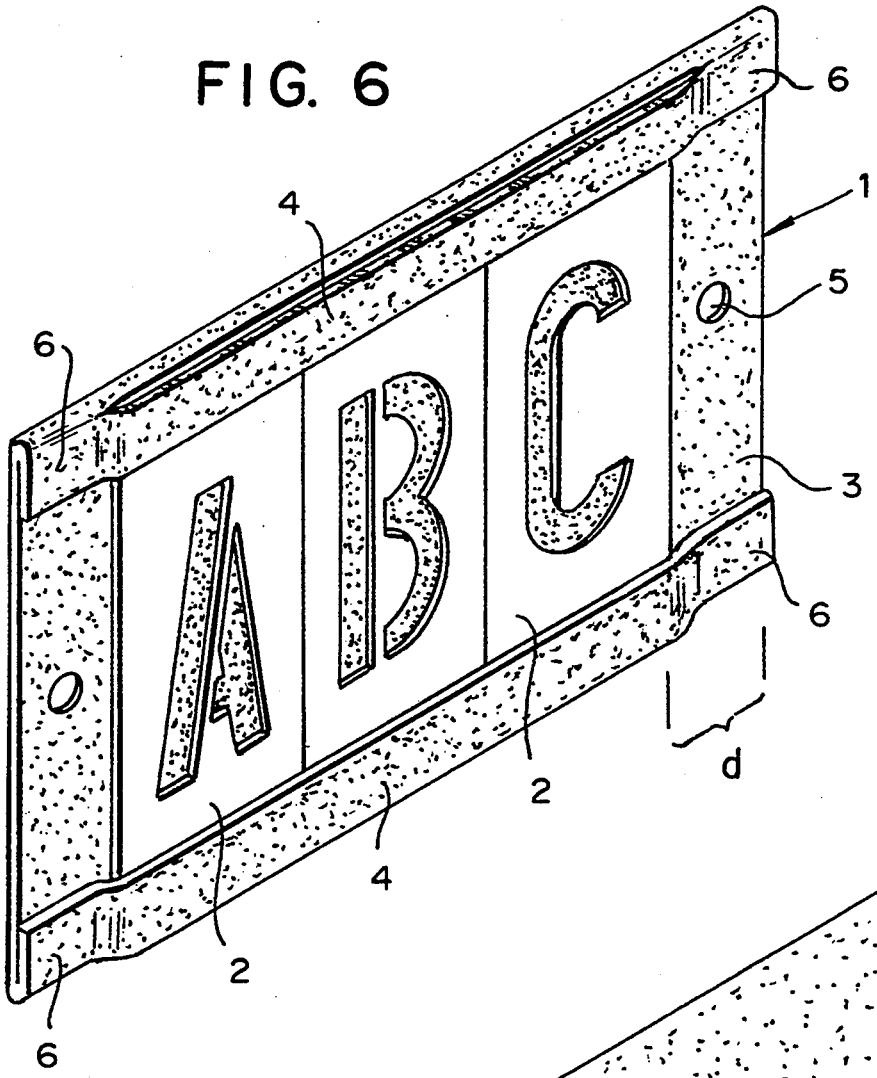
FIG. 6 is a perspective view of a finished sign seen from the front and FIG. 7 is a view of the sign in FIG. 6 from behind.
Figure 7:
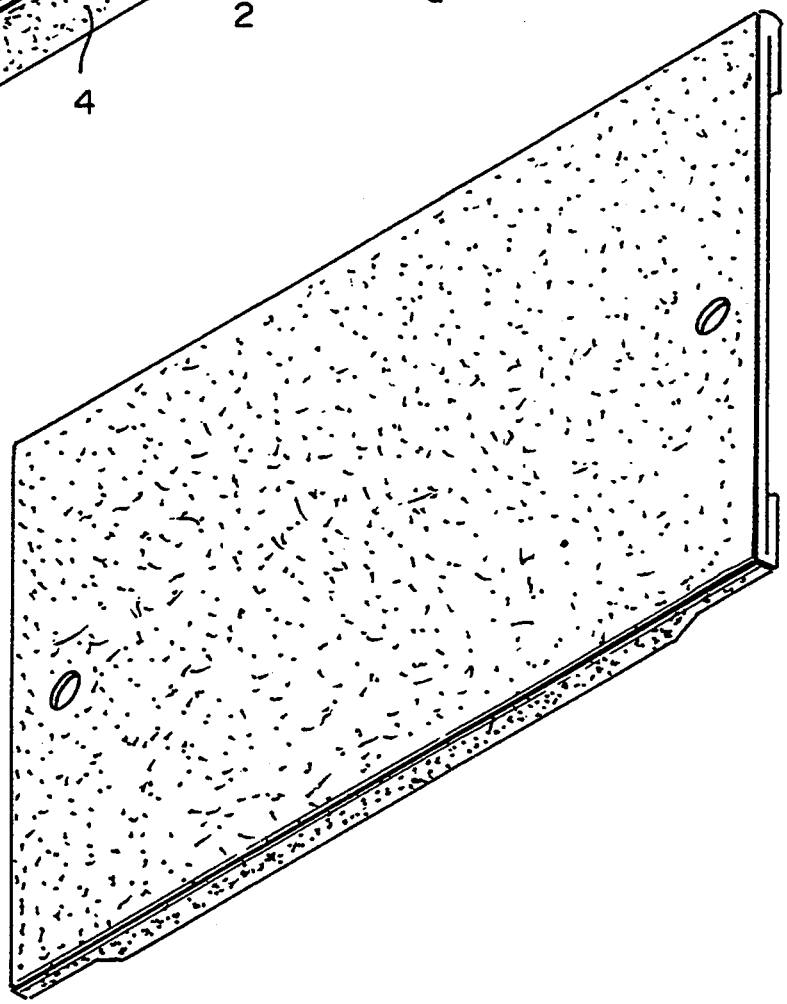
Figure 6:
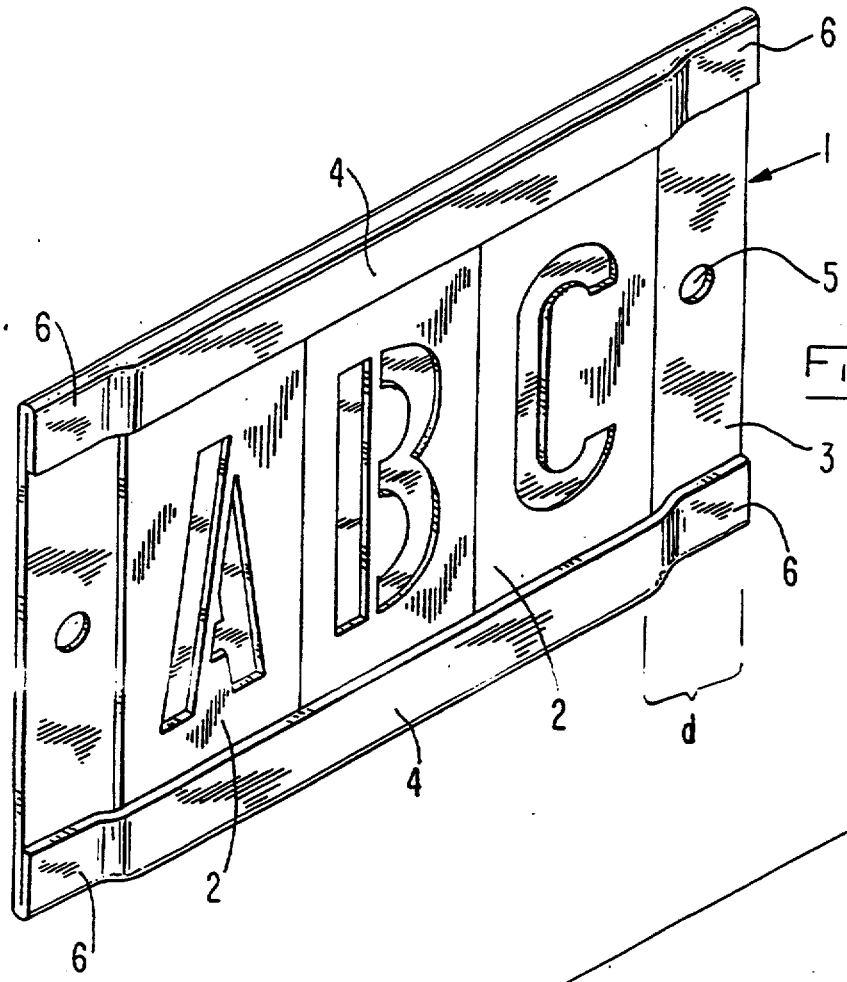
Figure 7:
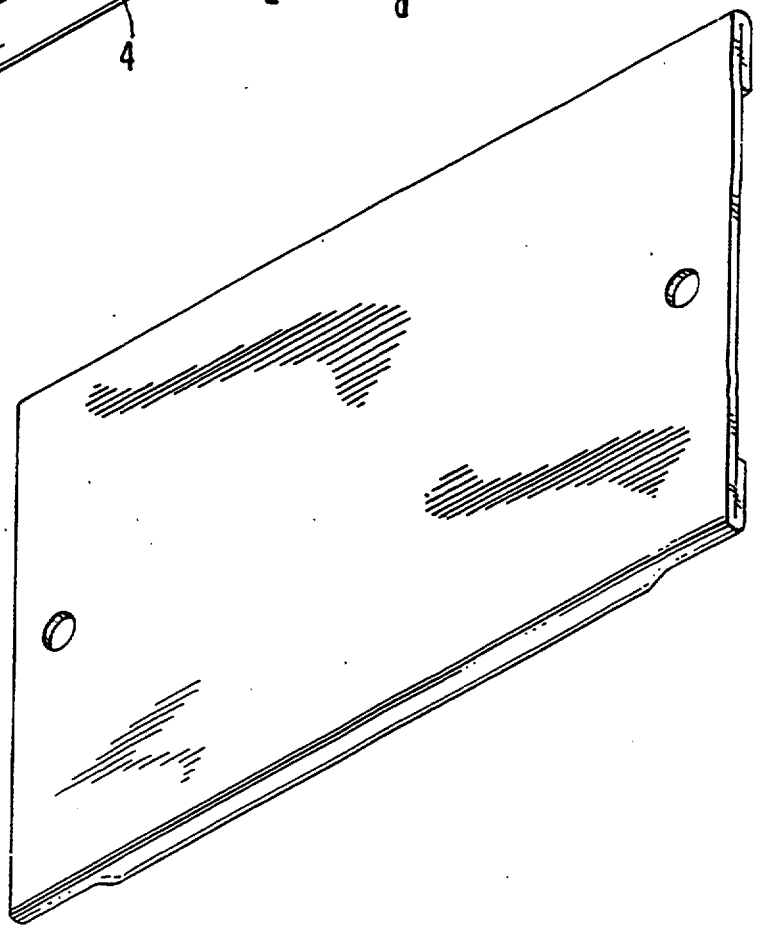

The tool according to the invention according to FIGS. 1–5 is primarily intended to be used for preparation of signs of the type which in the finished state is illustrated in FIGS. 6 and 7. The sign has a base section 1 and sign elements 2 engaging therewith. The sign elements 2 have the character of disc elements, preferably rectangular ones. The very signs or symbols on the sign elements may be produced by painting etc, but another possibility will be to punch the symbols aimed at out of the disc elements, so that accordingly the bottom portion 3 of the base section 1 will be visible through punchings in the sign elements.

The base section 1 has edge portions 4 folded over, which extend along the longitudinal edges of the base section 1, i.e. the upper and lower edges or borders. The sign elements 2 have such a width transversal to the longitudinal direction of the base section 1 that the sign elements will be received with the upper and lower edge portions thereof between the edge portions 4 folded over and the base portion 3 of the base section 1.

Holes 5 are arranged in the base portion of the base section 1 beside the sign elements 2, i.e. at both ends of the base section 1, and adapted to facilitate the securing of the sign to an arbitrary frame or underlayer. These holes 5 may for example receive nails, screws, rivets, wire etc.

The edge portions 4 of the base section 1 folded over are deformed at the ends at the portions designated by 6 in order to keep the sign elements 2 in place in the base section 1 by forming obstacles for the sign elements 2 to leave the engagement with the base section. The deformation in question means that the edge portions 4 in the region of the portions designated by 6 are pressed inwardly against the base portion 3 of the base section 1, so that the sign elements 2 may not be displaced past these portions 6.

The tool according to the invention (FIGS. 1–5) comprises two members 7, 8 movable with respect to each other. These members comprise on one hand edge means 9, 10 for cutting the base section 1 off, and on the other means 11, 12 (FIGS. 1 and 4) deforming the base section 1 in the regions designated by 6 in FIG. 6 so as to form the obstacles for the sign elements 2 to leave the engagement with the base section 1. The tool members 7, 8 further comprise means 13, 14 for cutting out holes 5 in the base section 1.

One of the tool members 7 has guiding surfaces 15, which define a seat 16 for the base section 1. This is displaceably movable in the seat 16 along the guiding surfaces 15 in the direction of the double arrow 17 in FIG. 3. The seat 16 is arranged to allow the base profile 1 to be displaced substantially perpendicularly to planes, in which the tool members 7, 8 are movable with respect to each other.

The tool members 7, 8 are in this example pivotably connected to each other about an axle 18. The base section 1 is accordingly displaceable in the seat 16 substantially parallelly to the pivot axle 18 between the members 7, 8.

The tool members 7, 8 have handles 19. The edge means 9, 10 and the deforming means 11, 12 are located between the pivot axle 18 and the handles 19, preferably considerably closer to the pivot axle 18 than the handles 19.

A stop member 20 is arranged in connection with the seat 16 for restricting the displacement of the sign in the direction towards the edge means 9, 10. The stop member 20 is designed to function as a stop for a sign element 2 located in the base section 1, which appear most clearly from FIGS. 4 and 5.

It appears from FIGS. 1–5 that the tool according to the invention in this example has the character of a hand tool which as a whole may be easily displaced in the room, while the work energy required has to be mobilized by the operator. It would of course be possible to make the tool motor driven, i.e. a suitable motor has to take care of the relative movement of the members 7 and 8. It should at this place also be pointed out that it is not necessary that the tool members 7, 8 are mutually pivotable, but they could also be movable with respect to each other in a translation movement.

Figure 3:
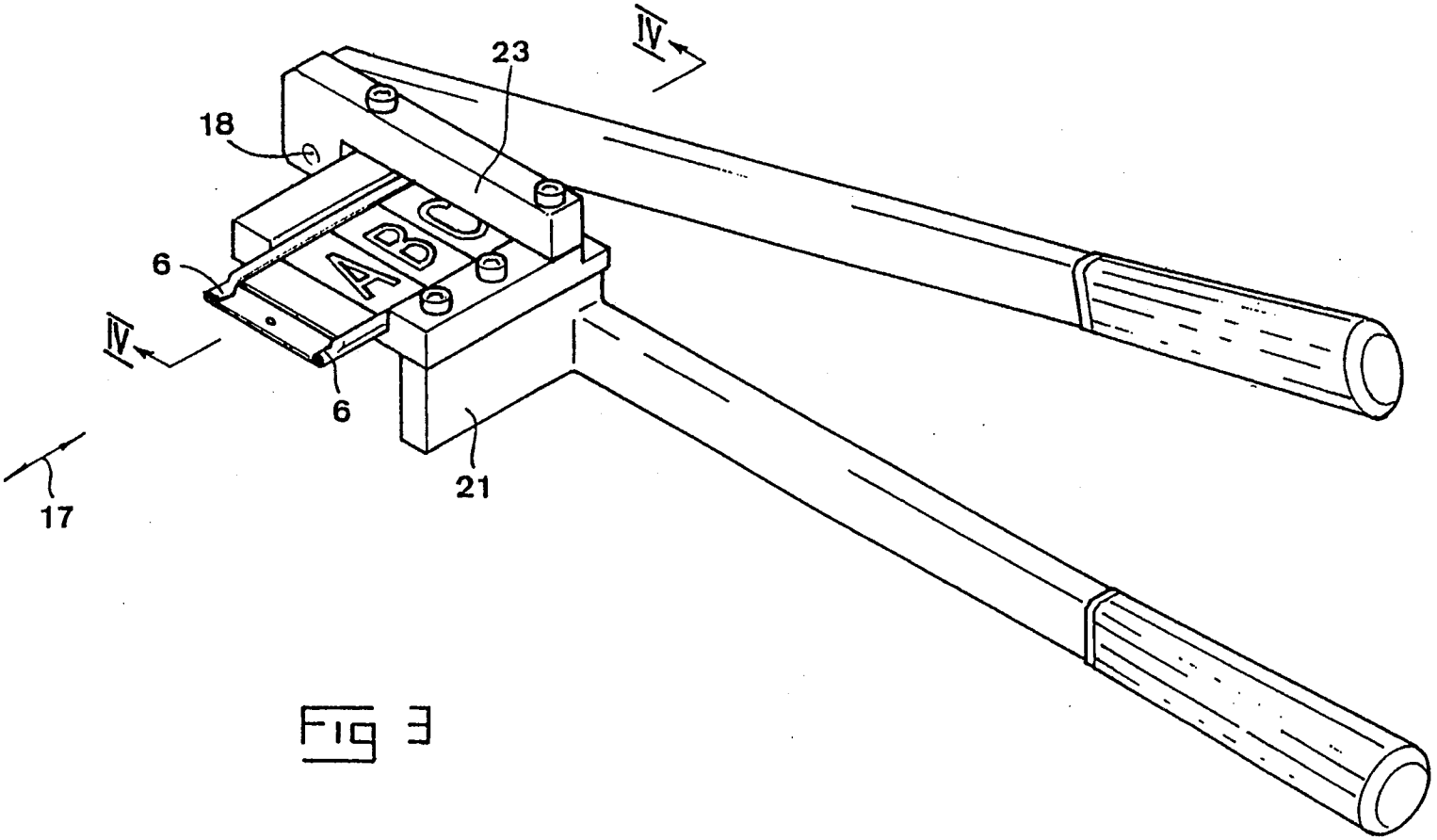
FIG. 3 is another perspective view of the tool with a sign introduced therein.

As appears from the figures the one tool member 7 has a plate-like cross portion 21, onto which a further plate member 22 is arranged. This plate member 22 has a countersink, which forms a seat 16 previously mentioned and which is laterally delimited by the guiding surfaces 15. The countersink or the seat 16 extends substantially transversely to the plane of the relative movement of the tool members 7, 8. The seat 16 for the base section 1 is bridged by a piece 23, on which the stop member 20 is arranged. The stop member has the character of a tongue projecting downwardly from the bridging piece 23 and which allows the base section 1 of the sign to pass between itself and the seat 16 but enters into contact with the closest adjacent ones of the sign elements 2 arranged in the base section so as to restrict the displacement of the design in the direction towards the edge means, so that a defined distance d (FIG. 5) is established between one end of the base 16 and the closest adjacent sign element after cutting this end of the base section off by means of the edge means 9, 10. This distance d is also indicated in FIG. 6. A condition for the function of the stop member 20 described is of course that the sign elements 2 may not be displaced out of the base section 1 at the opposite end of the sign. In other words it is required that, as indicated in FIG. 3, the base section has the edge portions 4 thereof at this other end pressed together in the regions 6 so as to form stop members preventing the sign elements 2 from being pushed out of the base section.

Figure 1:
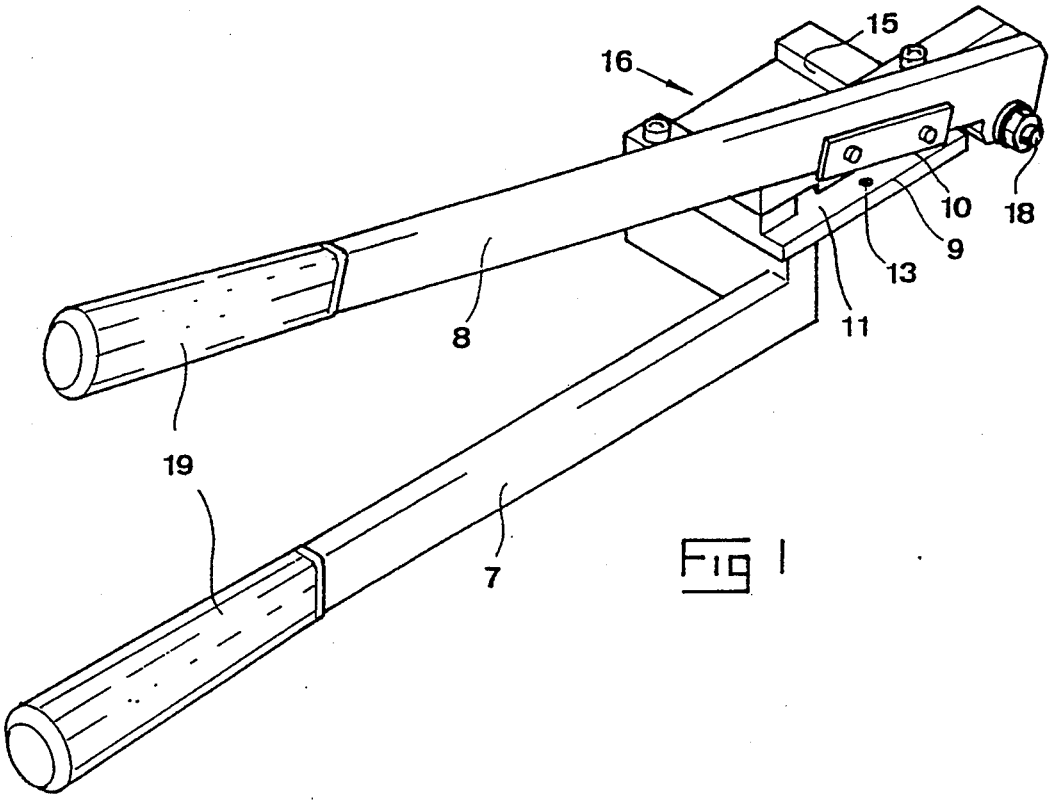
FIG. 1 is a perspective view of the tool according to the invention.
Figure 2:
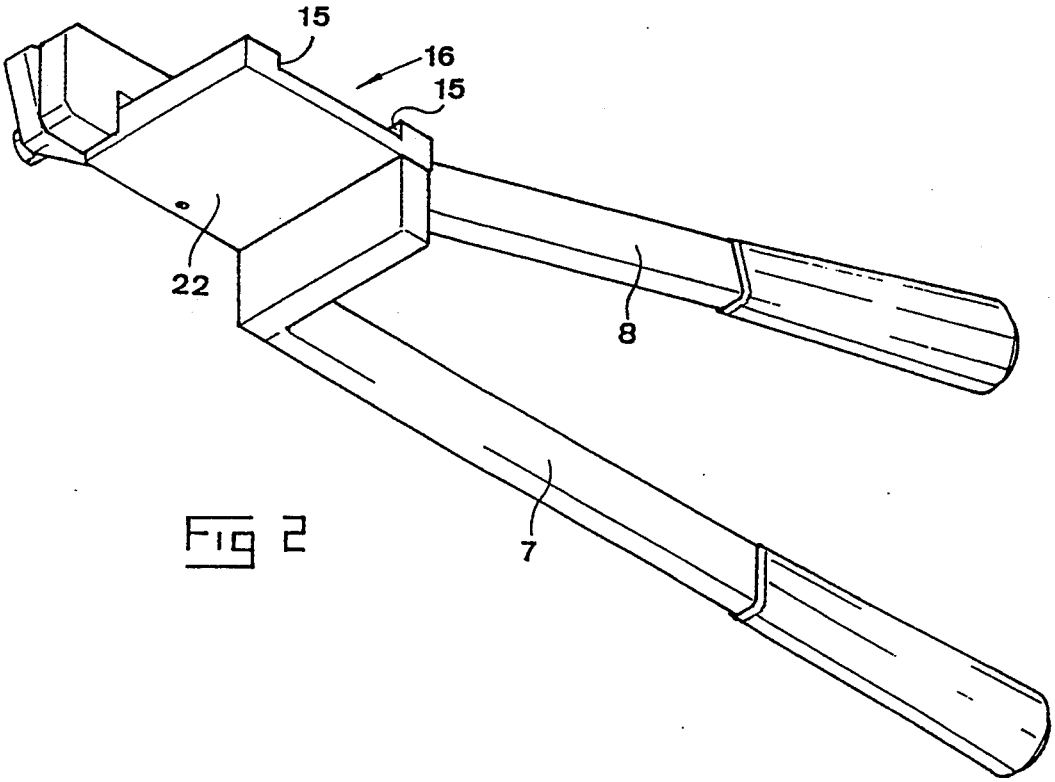
FIG. 2 is a further perspective view of the tool seen in another direction.

It appears from FIGS. 1, 4 and 5 that the edge means 9 is formed by an edge of the plate 22, while the edge means 10 is constituted by an edge on a separate cutting element 24, which is loosenably attachable to the tool member 8. The edge means 9 and 10 co-operate shearingly or cuttingly.

The deforming means 11 and 12 are simply constituted by surfaces on the tool members 7, 8, and these surfaces co-operate on moving the tool members towards each other, so that the surfaces jam edge portions of the base section 1 therebetween, so that the regions 6 appearing from FIG. 6 are created. The jam surfaces 11 and 12 are located between the stop member 20 and the edge means 9, 10.

The means 13, 14 for cutting out the holes 5 in the base section 1 comprise in this example a projecting pin on one of the tool members and a through-opening on the other tool member. The opening 13 is in the example made in the tool member 7, and more exactly as a through-opening through the plate 22 secured to this tool member. The pin 14 is in the form of punching means arranged on the tool member 8 and it is on moving the tool members towards each other intended to penetrate through the base portion 3 of the base section 1 while punching a material piece out thereof as a consequence of co-operation between the pin and the opening 13. The material piece is pushed downwardly into the opening 13, through the lower end of which the material piece later on will be discharged. A ring 25 made of an elastic material may be arranged around the pin 14 and it will then bear upon the upper side of the base portion 3 of the base section 1.

The tool according to the invention is used in the following way: it is initially assured that a base section 1 to be used for the production of a certain sign is provided with holes 5 and regions 6 jammed together at one end thereof. This may take place by providing the base section lengths in question at their one end with a hole 5 and the flattened region 6 directly in the manufacturing thereof. As an alternative it would be possible to see to this by introducing one end of the base section 1 in the tool before any sign elements are inserted so that it is located at the level of or projecting slightly past the edges 9, 10, whereupon the movement of the tool members 7, 8 towards each other causes portions of the base section 1 possibly projecting past the edges to be cut off, and holes 5 are punched by means of the means 13, 14 and jamming the region 6 together is obtained by means of the means 11, 12. This takes place in one single movement of the tool members towards each other. The base section 1 is after that removed from the tool and a suitable combination of sign- or symbol elements 2 is introduced therein. The sign work piece consisting of the base section 1 and the sign elements 2 inserted therein is then arranged in the tool as indicated in FIG. 3. The stop member 20 comes to bear against the sign element 2 located at one end and restricts the movement of the sign piece in the direction towards the edge means 9, 10. The tool members 7, 8 are then once again moved towards each other and the edge means 9, 10 cut the base section 1 off, the jamming means 11, 12 jam or clamp the edge portions 4 together while forming the regions 6 jammed together, and the hole 5 is cut out by means of the cutting means 13, 14. These three work operations are also here obtained by one and the same movement of the tool members 7, 8 towards each other. After separation of the tool members 7, 8 the finished sign may be removed from the tool and it has then the appearance appearing from FIGS. 6 and 7, i.e. the sign elements 2 are efficiently retained between the regions 6 jammed together at the ends of the base section 1. The sign is thereby ready to be applied at a desirable location.

It is self-evident that the tool according to the invention may be modified in several ways within the scope of the inventional idea.

I claim:

1. An apparatus for constructing signs wherein selective sign display elements are assembled on a base section by engagement with opposite edge portions of the base section said apparatus comprising at least two tool members relatively displaceable with respect to each other, said tool members defining cutting means for severing the base section, said tool members further including means for deforming the base section to secure the sign display elements from disengagement with the base section.

2. An apparatus for constructing signs as claimed in claim 1 wherein said tool members further define punch means for penetrating the base section to provide an aperture.

3. An apparatus for constructing signs as claimed in claim 1 wherein one of said tool members includes guiding surfaces defining a seat for receiving the base section.

4. An apparatus for constructing signs as claimed in claim 3 wherein the base section is displaceable within the seat.

5. An apparatus for constructing signs as claimed in claim 4 wherein the base section is displaceable in a plane which is substantially perpendicular to a plane in which the tool members are moveable with respect to each other.

6. An apparatus for constructing signs as claimed in claim 1 wherein the tool members are pivotally connected about an axle.

7. An apparatus for constructing signs as claimed in claim 6 wherein the tool members include a handle, said cutting means and said deforming means being located between the axle and the handle.

8. An apparatus for constructing signs as claimed in claim 4 further including stop means for restricting displacement of the base section in the direction of the cutting means.

9. An apparatus for constructing signs as claimed in claim 4 further including stop means interacting with the sign display element located in the base section for restricting movement of the sign display element in the direction of the cutting means.

10. An apparatus for constructing signs as claimed in claim 9 further including a bridge element overlying the seat with said stop means projecting from the bridge element toward the seat.

11. An apparatus for constructing signs as claimed in claim 9 wherein an edge portion of the base section is deformed in a region between the cutting means and the stop means.

12. An apparatus for constructing signs as claimed in claim 11 wherein an aperture is provided in said region of the base section.

13. An apparatus for constructing signs as claimed in claim 2 wherein the relative movement of the respective tool members simultaneously severs the base section, deforms of the base section and provides an aperture in the base section.

* * * * *

UNITED STATES PATENT AND TRADEMARK OFFICE

CERTIFICATE OF CORRECTION

PATENT NO. : 5,412,971

DATED : May 9, 1995

INVENTOR(S) : Stig Axelsson, Tranas, Sweden.

It is certified that error appears in the above-indentified patent and that said Letters Patent is hereby corrected as shown below:

Delete Drawing Sheet 4 of 4, and substitute therefor the Drawing Sheets, consisting of Figs. 6 and 7, as shown on the attached pages.

Signed and Sealed this

Fifteenth Day of August, 1995

Bruce Lehman

*Attest:*

BRUCE LEHMAN

*Attesting Officer*

*Commissioner of Patents and Trademarks*